US010032407B2

(12) United States Patent
Lee et al.

(10) Patent No.: US 10,032,407 B2
(45) Date of Patent: Jul. 24, 2018

(54) DISPLAY PANEL, DISPLAY APPARATUS AND CONTROLLING METHOD THEREOF

(71) Applicant: SAMSUNG ELECTRONICS CO., LTD., Suwon-si (KR)

(72) Inventors: Ho-seop Lee, Seongnam-si (KR); Do-young Kwag, Seoul (KR); Dae-sik Kim, Hwaseong-si (KR); Sang-kyun Im, Seoul (KR); Seong-phil Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/157,608

(22) Filed: May 18, 2016

(65) Prior Publication Data

US 2016/0343294 A1 Nov. 24, 2016

Related U.S. Application Data

(60) Provisional application No. 62/163,008, filed on May 18, 2015.

(30) Foreign Application Priority Data

Oct. 14, 2015 (KR) ..... 10-2015-0143609

(51) Int. Cl.

| | |
|---|---|
| ***G09G 5/10*** | (2006.01) |
| ***G09G 3/32*** | (2016.01) |
| ***G09G 3/36*** | (2006.01) |

(52) U.S. Cl.

CPC ..... *G09G 3/32* (2013.01); *G09G 3/3607* (2013.01); *G09G 2300/0452* (2013.01)

(58) Field of Classification Search

CPC . G09G 3/32; G09G 3/3607; G09G 2300/0452

See application file for complete search history.

(56) References Cited

U.S. PATENT DOCUMENTS

| | | | |
|---|---|---|---|
| 7,408,302 | B2 | 8/2008 | Min |
| 7,705,810 | B2 | 4/2010 | Choi et al. |
| 2004/0222999 | A1 | 11/2004 | Choi et al. |
| 2006/0245188 | A1 | 11/2006 | Takenaka |
| 2009/0046307 | A1 | 2/2009 | Kwak et al. |
| 2013/0070002 | A1 | 3/2013 | Hisada et al. |
| 2014/0014983 | A1 | 1/2014 | Edwards |
| 2014/0353694 | A1 | 12/2014 | Pang et al. |

(Continued)

FOREIGN PATENT DOCUMENTS

KR 10-0943273 B1 2/2010

OTHER PUBLICATIONS

Search Report dated Aug. 29, 2016, issued by the International Searching Authority in counterpart International Patent Application No. PCT/KR2016/005250 (PCT/ISA/210).

(Continued)

*Primary Examiner* — Jonathan Boyd

(74) *Attorney, Agent, or Firm* — Sughrue Mion, PLLC

(57) ABSTRACT

A display panel is provided. The display panel includes pixels that include a red (R) subpixel, a green (G) subpixel, a blue (B) subpixel, and a white (W) subpixel arranged in a first package and a second package disposed adjacent to the first package. The first package includes the B subpixel and the G subpixel and the second package includes the R subpixel and the W subpixel.

17 Claims, 16 Drawing Sheets

(56) References Cited

U.S. PATENT DOCUMENTS

2015/0123083 A1 5/2015 Xi et al.

OTHER PUBLICATIONS

Written Opinion dated Aug. 29, 2016, issued by the International Searching Authority in counterpart International Patent Application No. PCT/KR2016/005250 (PCT/ISA/237).
Communication dated Jan. 3, 2018, from the European Patent Office in counterpart European Application No. 16796769.4.

DISPLAY PANEL, DISPLAY APPARATUS AND CONTROLLING METHOD THEREOF

CROSS-REFERENCE TO RELATED APPLICATIONS

This application claims the benefit of priority from U.S. Provisional Application No. 62/163,008, filed on May 18, 2015 in the United States Patent & Trademark Office and priority from Korean Patent Application No. 10-2015-0143609, filed on Oct. 14, 2015 in the Korean Intellectual Property Office, the disclosures of which are herein incorporated by reference in their entireties.

BACKGROUND

1. Field

Apparatuses and methods consistent with what is disclosed herein relate to a display panel, a display apparatus and a controlling method thereof, and more specifically, to a display panel having a plurality of pixels including R (red), G (green), B (blue), and W (white) subpixels, a display apparatus and a controlling method thereof.

2. Description of the Related Art

With the advancing electronic technology, various types of electronic products have been developed and distributed. Specifically, various display apparatuses such as TVs, portable phones, PCs, laptop PCs, PDAs, and so on, are widely used in most homes.

While use of the display apparatuses increases, user needs for more diverse functions have become expanded. Accordingly, manufacturers put more efforts to meet the user needs, and new products providing new functions which are not previously available are launched.

Specifically, with increasing use of LED display apparatuses for advertisements or store sign boards, various technologies to efficiently drive LED display apparatuses emerged.

However, the related art LED display apparatuses use R (red), G (green), B (blue) LEDs. In this case, high power consumption requires separate electrical power installation, and the cost for using electrical power is burdensome.

Further, the related art technologies cannot produce one package form including all of R, G, B, and white (W) LEDs and the production cost would greatly increase when each of R, G, B, and W LED is each formed as subpixels.

SUMMARY

Exemplary embodiments overcome the above disadvantages and other disadvantages not described above. Also, exemplary embodiments are not required to overcome the disadvantages described above, and an exemplary embodiment may not overcome any of the disadvantages described above.

It is an aspect to provide a display panel implementing and including R (red), G (green), B (blue), and W (white) subpixels as two packages, a display apparatus and a controlling method thereof.

According to an aspect of an exemplary embodiment, there is provided a display panel comprising a plurality of pixels, each pixel comprising a red (R) subpixel, a green (G) subpixel, a blue (B) subpixel, and a white (W) subpixel arranged in a first package and a second package disposed adjacent to the first package, wherein the first package comprises the B subpixel and the G subpixel and the second package comprises the R subpixel and the W subpixel.

A partition may be disposed between the first package and the second package to prevent transmission of light emitted from the B subpixel and the G subpixel to the second package, and to prevent transmission of light emitted from the R subpixel and the W subpixel to the first package.

The W subpixel may comprise a blue (B) subpixel covered by a yellow phosphor.

The R, G, B, and W subpixels each may be implemented as a light emitting diode (LED).

According to another aspect of an exemplary embodiment, there is provided a display apparatus comprising a display panel comprising a plurality of pixels, each pixel comprising a red (R) subpixel, a green (G) subpixel, a blue (B) subpixel, and a white (W) subpixel arranged in a first package and a second package disposed adjacent to the first package; a panel driver configured to drive the display panel; a processor configured to, for each pixel, determine a W subpixel value by signal-processing R, G, B data for the pixel included in an inputted video signal, determine R, G, B subpixel values based on the determined W subpixel value, and control the panel driver so that the R, G, B, and W subpixels are turned on based on the determined R, G, B, and W subpixel values, wherein the first package comprises the B subpixel and the G subpixel and the second package comprises the R subpixel and the W subpixel.

A partition may be disposed between the first package and the second package to prevent transmission of a light emitted from the B subpixel and the G subpixel to the second package, and to prevent transmission of a light emitted from the R subpixel and the W subpixel to the first package.

The W subpixel may comprise a blue (B) subpixel covered by a yellow phosphor.

The R, G, B, and W subpixels each may be implemented as a light emitting diode (LED).

The processor may perform, for each pixel, gamma conversion regarding R, G, B data, determines a W subpixel value based on the gamma-converted R, G, B data, and determines R, G, B subpixel values by performing inverse gamma conversion regarding a rest of the gamma-converted R, G, B data excluding the determined W subpixel value.

The processor may control the panel driver so that, in one video frame section, a plurality of subpixels are turned on as a preset group unit, and the subpixel groups arranged at a position shifted by a preset subpixel unit are sequentially turned on.

According to another aspect of an exemplary embodiment, there is provided a controlling method of a display apparatus including a display panel including a plurality of pixels, each pixel comprising a red (R) subpixel, a green (G) subpixel, a blue (B) subpixel, and a white (W) subpixel arranged in a first package and a second package disposed adjacent to the first package, the first package comprising the B subpixel and the G subpixel, and the second package comprising the R subpixel and the W subpixel, the controlling method comprising determining, for each pixel, a W subpixel value by signal-processing R, G, B data included in an inputted video signal; determining R, G, B subpixel values based on the determined W subpixel value; and controlling so that R, G, B, and W subpixels are turned on based on the determined R, G, B, and W subpixel values.

A partition may be disposed between the first package and the second package to prevent transmission of a light emitted from the B subpixel and the G subpixel to the second package, and to prevent transmission of a light emitted from the R subpixel and the W subpixel to the first package.

The W subpixel may comprise a blue (B) subpixel covered by a yellow phosphor.

The R, G, B, and W subpixels each may be implemented as a light emitting diode (LED).

The determining the W subpixel value may comprise performing gamma conversion regarding R, G, B data, and determining the W subpixel value based on the gamma-converted R, G, B data.

The determining the R, G, B subpixel values may comprise determining R, G, B subpixel values by performing inverse gamma conversion regarding a rest of the gamma-converted R, G, B data excluding the determined W subpixel value.

The controlling method may further comprise controlling so that, in one video frame section, a plurality of pixels are turned on by a preset group unit, and the subpixel groups arranged at a position shifted by a preset subpixel unit are sequentially turned on.

According to another aspect of an exemplary embodiment, there is provided a display panel comprising a plurality of pixels, each pixel comprising a red (R) subpixel, a green (G) subpixel, a blue (B) subpixel, and a white (W) subpixel arranged in a first package and a second package disposed adjacent to the first package, wherein each of the first and second packages includes a plate having two subpixels disposed thereon, and only a R subpixel is provided in a same package as a W subpixel.

Each pixel may further comprise a partition disposed between the first package and the second package to prevent transmission of light emitted from subpixels of the first package to the second package, and to prevent transmission of light emitted from subpixels of the second package to the first package.

The W subpixel may comprise a blue (B) subpixel covered by a yellow phosphor.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
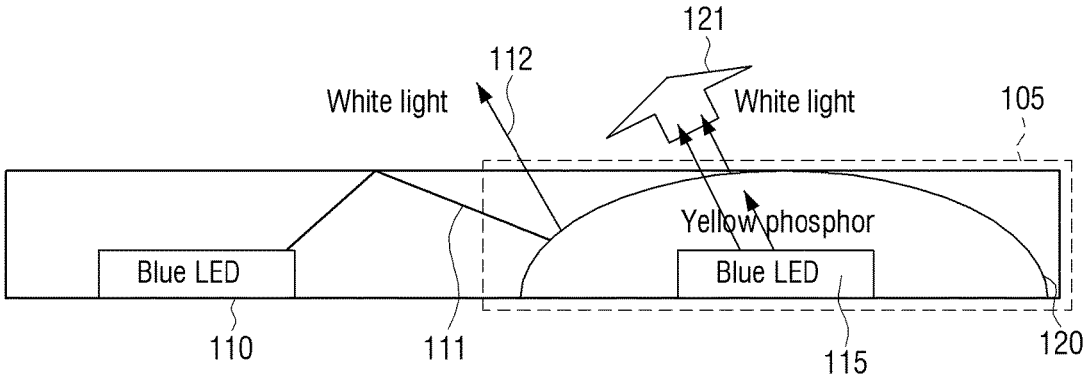
FIG. 1 is a diagram illustrating an example in which B (blue) and W (white) subpixels are disposed adjacent to each other.

Certain exemplary embodiments will now be described in greater detail with reference to the accompanying drawings.

In the following description, same drawing reference numerals are used for the same elements even in different drawings. The matters defined in the description, such as detailed construction and elements, are provided to assist in a comprehensive understanding of the present inventive concept. Accordingly, it is apparent that the exemplary embodiments can be carried out without those specifically defined matters. Also, well-known functions or constructions are not described in detail since they would obscure the present inventive concept with unnecessary detail. Further, terms and expressions described herein are defined in consideration of the functions in the present disclosure, and may change depending on the intention of a user or an operator, or relations. Accordingly, terms and expressions will have to be defined based on the overall content of the present disclosure.

FIG. 1 is a diagram illustrating an example in which B (blue) and W (white) subpixels are disposed adjacent to each other.

Referring to FIG. 1, a W subpixel 105 may include a B subpixel 115 and a yellow phosphor 120, and emit a white light 121 as the light emitted from the B subpixel 115 passes through the yellow phosphor 120.

Herein, when a B subpixel 110 disposed adjacent to W subpixel 105 is illuminated, the light 111 emitted from the B subpixel 110 may be reflected from the yellow phosphor 120 included in W subpixel 105, in which case the white light 112 may be emitted unintentionally.

Herein, among the light emitted from the B subpixel 110, the light reflected from the yellow phosphor 120 included in the W subpixel 105 is referred to as an 'excitation wavelength'.

Accordingly, when the B subpixel 110 disposed adjacent to the W subpixel 105 turns on, the blue color light and the white light 121 may be mixed and emitted, rather than pure blue color light being emitted.

Further, in a similar manner, because green color light emitted from a G (green) subpixel is positioned on a similar wavelength bandwidth to that of the blue color light emitted from the B subpixel 110, when the green color light is reflected from the yellow phosphor 120, the white light 121 may be emitted.

When it is assumed that a G subpixel is disposed adjacent to a W subpixel 105 instead of the B subpixel 110 in FIG. 1, as G subpixel is illuminated, the light emitted from the G subpixel may be reflected from the yellow phosphor 120 included in the W subpixel 105, and the white light 121 may be emitted unintentionally.

Accordingly, pure blue color light and green color light may be emitted in response to respective turning on of a B subpixel and a G subpixel only when the B subpixel and the G subpixel are not disposed adjacent to a W subpixel.

On the other hand, red color light emitted from a R (red) subpixel is positioned on a wavelength bandwidth different from those of blue color light and green color light respectively emitted from a B subpixel and a G subpixel. Thus, even when the red color light emitted from the R subpixel is reflected from the yellow phosphor 120 included in the W subpixel 105, no white light 121 will be emitted.

Thus, a B subpixel and a G subpixel may be gathered in one package, and a R subpixel and a W subpixel may be gathered in another package. Accordingly, the constitution of the pixels including R, G, B, and W subpixels according to an exemplary embodiment may be implemented as illustrated in FIG. 2.

Figure 2:
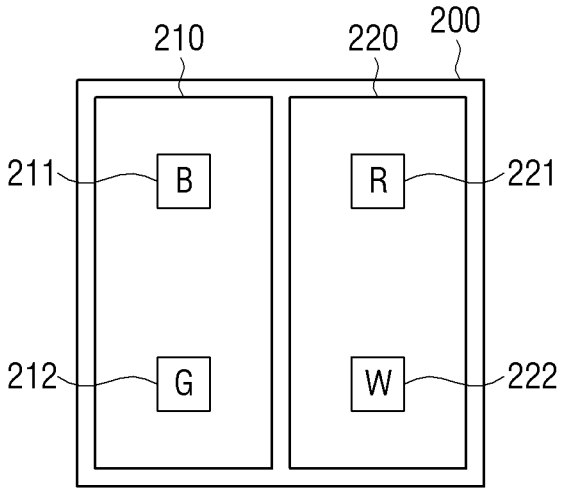
FIG. 2 is a diagram illustrating configuration of a pixel including R (red), G (green), B, and W subpixels according to an exemplary embodiment.

FIG. 2 is a diagram illustrating a configuration of a pixel including R, G, B, and W subpixels according to an exemplary embodiment.

Regarding a display panel having a plurality of pixels including R, G, B, and W subpixels, the plurality of pixels may each include a first package, and a second package disposed adjacent to the first package. The first package may include a B subpixel and a G subpixel, and the second package may include a R subpixel and a W subpixel.

Referring to FIG. 2, one pixel 200 including an R subpixel 221, a G subpixel 212, a B subpixel 211, a W subpixel 222 may include the first package 210 and the second package 220. Herein, the package refers to a plate including two subpixels among R, G, B, and W subpixels.

The first package 210 may include the B subpixel 211 and the G subpixel 212, and the second package 220 may include the R subpixel 221 and the W subpixel 222, as shown in FIG. 2.

A partition may be disposed between the first package 210 and the second package 220. The partition shields the second package 220 from the transmission of the blue color light and the green color light respectively emitted from the B subpixel 211 and the G subpixel 212 of the first package 210, and shields the first package 210 from the transmission of the light emitted from the R subpixel 221 and the W subpixel 222 of the second package 220. That is, the partition prevents crossover of the light from the first package 210 to the second package 220, and vice versa.

By disposing the partition between the first package 210 and the second package 220, the blue color light emitted from the B subpixel 211 and the green color light emitted from the G subpixel 212 may be prevented from being transmitted to the second package 220. Thus, the blue color light emitted from the B subpixel 211 and the green color light emitted from the G subpixel 212 may be prevented from being reflected from the yellow phosphor of the W subpixel 222 within the second package 220 and accordingly, emission of the white light is prevented.

Figure 3:
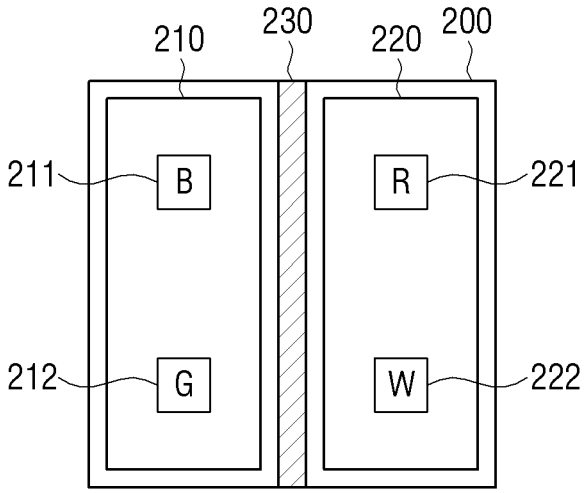
FIG. 3 is a diagram provided to explain a partition according to an exemplary embodiment.

FIG. 3 is a diagram provided to explain a partition according to an exemplary embodiment.

Referring to FIG. 3, the partition 230 may be disposed between the first package 210 including the B subpixel 211 and the G subpixel 212, and the second package 220 including the R subpixel 221 and the W subpixel 222, as illustrated in FIG. 2.

The partition 230 may prevent the transmission of the blue color light emitted from the B subpixel 211 and the green color light emitted from the G subpixel 212 to the second package 220. In other words, the phenomenon in which the blue color light emitted from the B subpixel 211 and the green color light emitted from the G subpixel 212 are reflected from the yellow phosphor of W subpixel 222 included within the second package, causing emission of the white light, may be prevented.

The partition 230 may be implemented with a material that is the same as the material of the structure forming the first package 210 or the second package 220.

Referring to FIG. 3, it is explained above that the B subpixel 211 and the G subpixel 212 may be included within the first package 210, and the R subpixel 221 and the W subpixel 222 may be included within the second package 220. However, exemplary embodiments are not limited herein. Accordingly, the B subpixel 211 and the G subpixel 212 may be included in the second package 220 and the R subpixel 221 and the W subpixel 222 may be included in the first package 210.

The above-described W subpixel 222 may be implemented to include the B subpixel and the yellow phosphor. Further, R, G, B, and W subpixels 221, 212, 211, 222 may be implemented as LEDs.

The first package including the B subpixel 211 and the G subpixel 212 and the second package including the R subpixel 221 and the W subpixel 222 may be variously arranged, which will be specifically explained below by referring to FIGS. 4 and 11.

FIGS. 4 to 11 are diagrams provided to explain various arrangement structures of the first package and the second package according to various exemplary embodiments.

Figure 4:
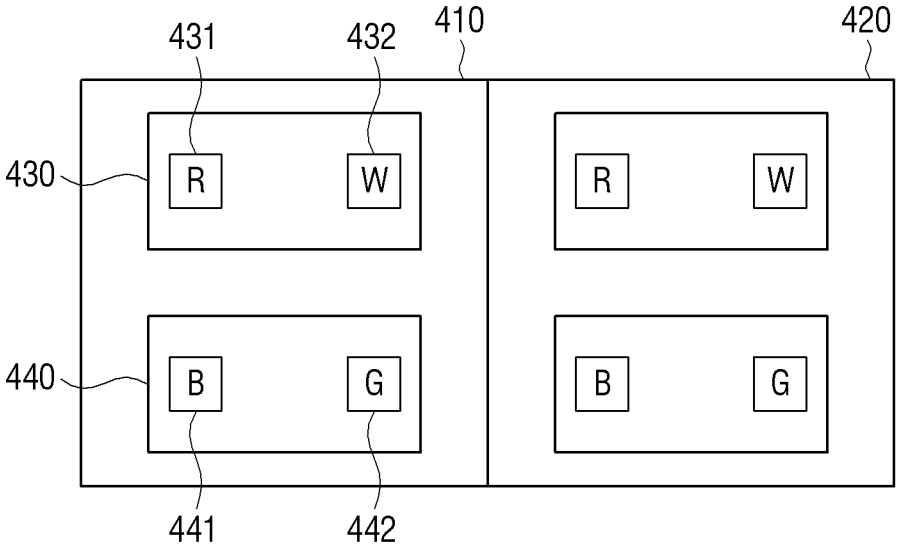
FIGS. 4 to 11 are diagrams provided to explain various arrangement structures of a first package and a second package according to various exemplary embodiments.

Referring to FIG. 4, a first pixel 410 and a second pixel 420 may be arranged and connected to each other. The first pixel 410 may include a first package 430 including a R subpixel 431 and a W subpixel 432, and a second package 440 including a B subpixel 441 and a G subpixel 442.

Herein, differently from FIG. 3, the first package 430 and the second package 440 of FIG. 4 may be arranged with subpixels abreast in a horizontal direction, the R subpixel 431 and the W subpixel 432 may be included in the first package 430 arranged on a first row in the first pixel 410, and the B subpixel 441 and the G subpixel 442 may be included in the second package 440 arranged on a second row in the first pixel 410.

Thus, when compared with the configuration in FIG. 3, the configuration of R, G, B, and W subpixels formed on the pixel 200 in FIG. 3 may be arranged clockwise according to an order of B, R, W, and in contrast, the configuration of R, G, B, and W subpixels formed on the pixel 410 in FIG. 4 may be arranged clockwise according to an order of R, W, G, and B.

However, FIG. 3 and FIG. 4 are common in that a W subpixel is not included in one package with a B subpixel and/or a G subpixel.

Figure 5:
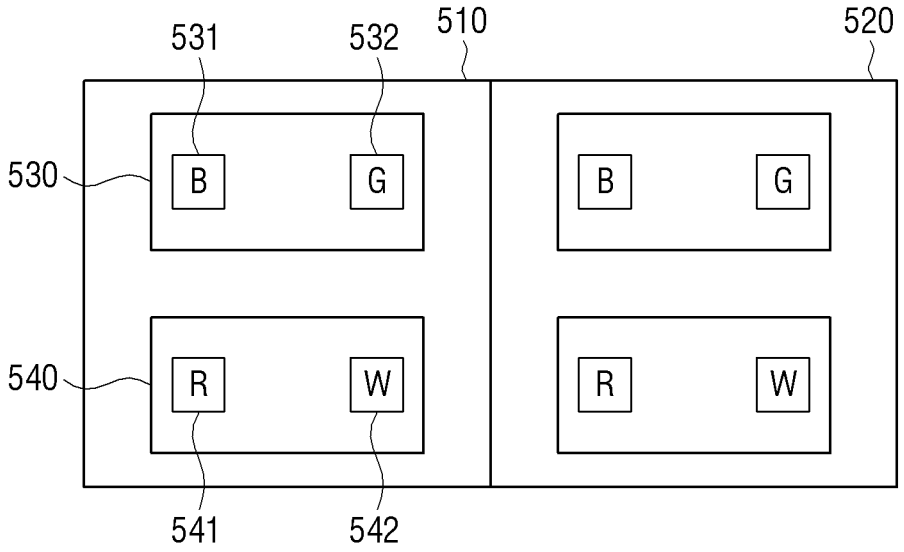

Further, referring to FIG. 5, a first pixel 510 and a second pixel 520 may be arranged and connected to each other, and the first pixel 510 may include a first package 530 including a B subpixel 531 and a G subpixel 532 and a second package 540 including a R subpixel 541 and a W subpixel 542.

Herein, the first package 530 and the second package 540 in FIG. 5 may be arranged with subpixels abreast in a horizontal direction, which is same as FIG. 4. However, differently from FIG. 4, the B subpixel 531 and the G subpixel 532 may be included in the first package 530 arranged on a first row in the first pixel 510, and the R subpixel 541 and the W subpixel 542 may be included in the second package 540 arranged on a second row in the first pixel 510.

Thus, when comparing with FIG. 4, the configuration of R, G, B, and W subpixels formed on the first pixel 410 in FIG. 4 may be arranged clockwise according to an order of R, W, G, and B, while the configuration of R, G, B, and W subpixels formed on the first pixel 510 in FIG. 5 may be arranged clockwise according to an order of B, G, W, and R.

Also in FIG. 5, the W subpixel 542 is not included in one package with the B subpixel 531 and/or the G subpixel 532.

Figure 6:
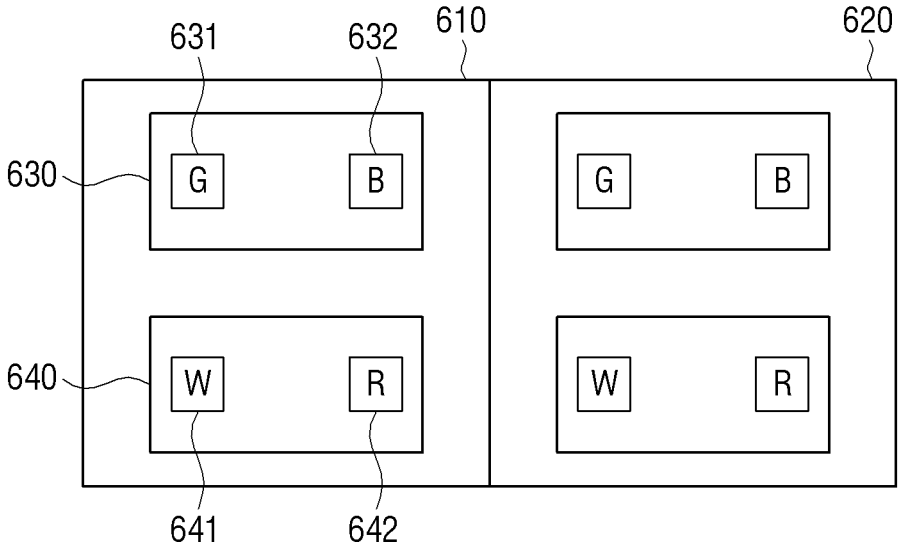

Referring to FIG. 6, a first pixel 610 and a second pixel 620 may be arranged and connected to each other, the first pixel 610 may include a first package 630 including a G subpixel 631 and a B subpixel 632, and a second package 640 including a W subpixel 641 and a R subpixel 642.

Comparing FIG. 6 with FIG. 5 shows that the positions of the G subpixel 631 and the B subpixel 632 are changed with each other within the first package 630 with respect to the first package 530 of FIG. 5. That is, the first package 530 of FIG. 5 may arrange the B subpixel 531 on the left side and the G subpixel 532 on the right side, while the first package 630 of FIG. 6 may arrange the G subpixel 631 on the left side and the B subpixel 632 on the right side.

Further, compared to FIG. 5, the positions of the W subpixel 641 and the R subpixel 642 are shown as being changed with each other within the second package 640 with respect to the second package 540 of FIG. 5. The second package 540 of FIG. 5 may have the R subpixel 541 on the left side and the W subpixel 542 on the right side, while the second package 640 of FIG. 6 may have the W subpixel 641 on the left side and the R subpixel 642 on the right side.

In the above case, the configuration of R, G, B, and W subpixels formed on the first pixel 510 in FIG. 5 may be arranged clockwise according to an order of B, G, W, and R, while the constitution of R, G, B, and W subpixels formed on the first pixel 610 in FIG. 6 may be arranged clockwise according to an order of G, B, R, and W.

The W subpixel 641 of FIG. 6 is not included in one package with the G subpixel 631 and/or the B subpixel 632.

Figure 7:
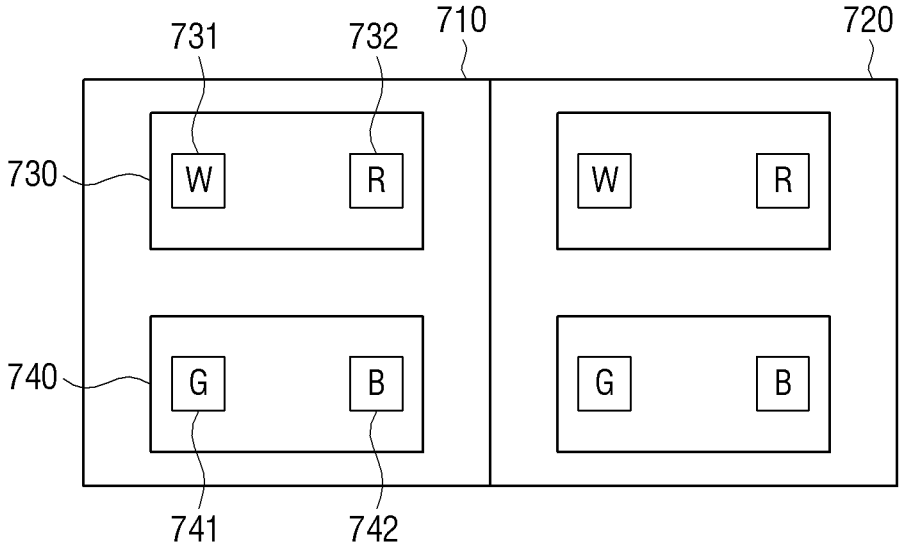

Further, referring to FIG. 7, a first pixel 710 and a second pixel 720 may be connected to each other, and the first pixel 710 may include a first package 730 including a W subpixel 731 and a R subpixel 732, and a second package 740 including a G subpixel 741 and a B subpixel 742.

Herein, when comparing FIG. 7 with FIG. 6, the types of the subpixels included in the first package 730 may be changed with the types of the subpixels included in the second package 740. Thus, the first package 630 of FIG. 6 may include the G subpixel 631 and the B subpixel 632 and the second package 640 may include the W subpixel 641 and the R subpixel 642, while the first package 730 of FIG. 7 may include the W subpixel 731 and the R subpixel 732 and the second package 740 may include the G subpixel 741 and the B subpixel 742.

In the above case, the configuration of R, G, B, and W subpixels formed on the first pixel 610 in FIG. 6 may be arranged clockwise according to an order of G, B, R, and W, while the configuration of R, G, B, and W subpixels in FIG. 7 may be arranged clockwise according to an order of W, R, B, and G.

The W subpixel 731 of FIG. 7 is not included in one package with the G subpixel 741 and/or the B subpixel 742.

Figure 8:
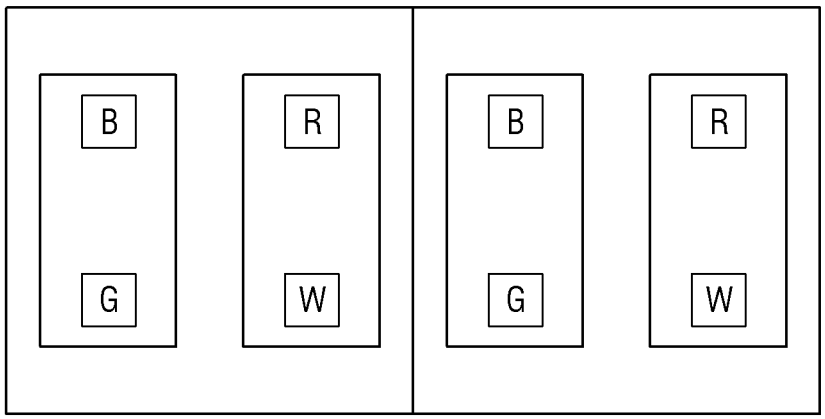

Referring to FIG. 8, the subpixels of the first package and the second package may be arranged abreast in a vertical direction within the pixel; which is the same as the structure in which the first package 430 and the second package 440 included within the pixel in FIG. 4 are rotated clockwise and arranged.

In the above case, the configuration of R, G, B, and W subpixels formed on the first pixel 410 in FIG. 4 may be arranged clockwise according to an order of R, W, G, and B, while the configuration of R, G, B, and W subpixels in FIG. 8 may be arranged clockwise according to an order of B, R, W, and G.

The W subpixel of FIG. 8 is not included within one package with the B subpixel and/or the G subpixel.

Figure 9:
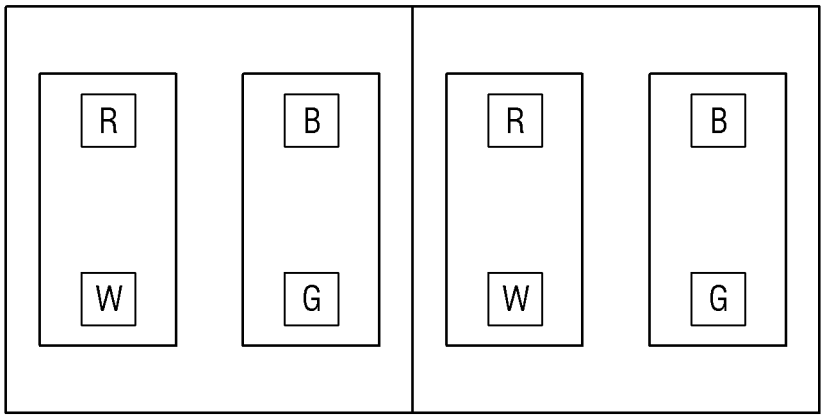

Referring to FIG. 9, the subpixels of the first package and the second package may be arranged abreast in a vertical direction within the pixel, which is the same as the structure in which the first package 530 and the second package 540 included within the pixel in FIG. 5 are rotated clockwise and arranged.

In the above case, the configuration of R, G, B, and W subpixels formed on the first pixel 510 in FIG. 5 may be arranged clockwise according to an order of B, G, W, and R, while the configuration of R, G, B, and W subpixels may be arranged clockwise according to an order of R, B, G, and W.

The W subpixel of FIG. 9 is not included in one package with the B subpixel and/or the G subpixel.

Figure 10:
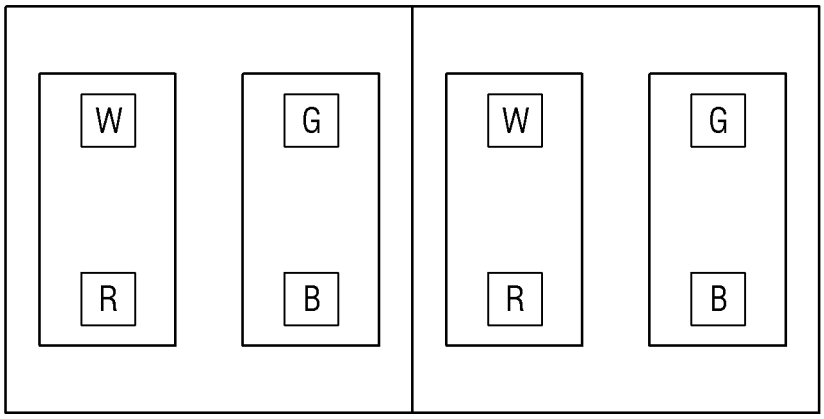

Referring to FIG. 10, the subpixels of the first package and the second package may be arranged abreast in a vertical direction within the pixel, which is the same as the structure in which the first package 630 and the second package 640 included within the pixel of FIG. 6 are rotated clockwise and arranged.

In the above case, the configuration of R, G, B, and W subpixels formed on the first pixel 630 in FIG. 6 may be arranged clockwise according to an order of G, B, R, and W, while the constitution of R, G, B, and W subpixels in FIG. 10 may be arranged clockwise according to an order of W, G, B, and R.

The W subpixel of FIG. 10 is not included in one package with the B subpixel and/or the G subpixel.

Figure 11:
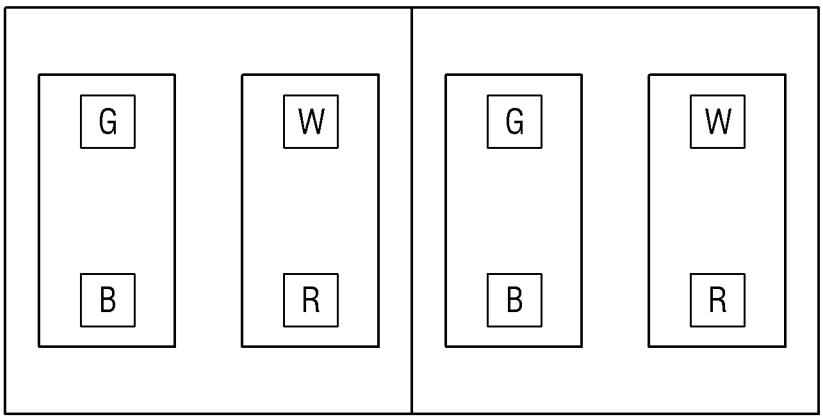

Referring to FIG. 11, the subpixels of the first package and the second package may be arranged abreast in a vertical direction within the pixel, which is the same as the structure in which the first package 730 and the second package 740 included within the pixel in FIG. 7 are rotated clockwise and arranged.

In the above case, the configuration of R, G, B, and W subpixels formed on the first pixel 710 in FIG. 7 may be arranged clockwise according to an order of W, R, B, and G, while the configuration of R, G, B, and W subpixels in FIG. 11 may be arranged clockwise according to an order of G, W, R, and B.

The W subpixel of FIG. 11 is not included in one package with the B subpixel and/or the G subpixel.

R, G, B, and W subpixels according to various an exemplary embodiments may be arranged at various positions as illustrated in FIGS. 4 to 11, based on the common characteristic in that W subpixel is not arranged in one package with a B subpixel and/or a G subpixel.

Further, although FIGS. 4 to 11 do not illustrate the partition inside the pixel, the partition, which prevents the transmission of the blue color light emitted from the B subpixel and/or the green color light emitted from the G subpixel to the phosphor included in the W subpixel, may be arranged between the first package and the second package, as illustrated in FIG. 3.

Figure 12A:
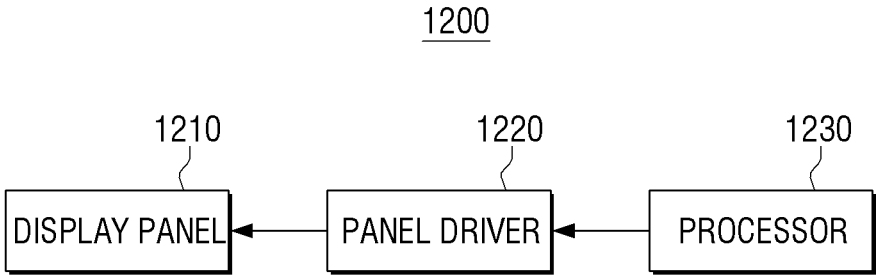
FIG. 12A is a block diagram of a display apparatus according to an exemplary embodiment.

FIG. 12A is a block diagram of a display apparatus according to an exemplary embodiment.

Referring to FIG. 12A, the display apparatus 1200 may include a display panel 1210, a panel driver 1220 and a processor 1230. Herein, the display apparatus 1200 may be implemented to be a diverse type of electronic apparatus such as a TV, an electronic a blackboard, an electronic table, a large format display (LFD), a smart phone, a tablet PC, a desktop PC, a laptop, and so on. Specifically, the display apparatus may include any electronic device that can display images through LED components.

Herein, the display panel 1210 may include a plurality of pixels, each including R, G, B, and W subpixels. A W subpixel may be implemented to include a B subpixel and the yellow phosphor.

Further, the panel driver 1220 may drive the display panel 1210, which will be specifically explained below by referring to FIG. 12B.

Figure 12B:
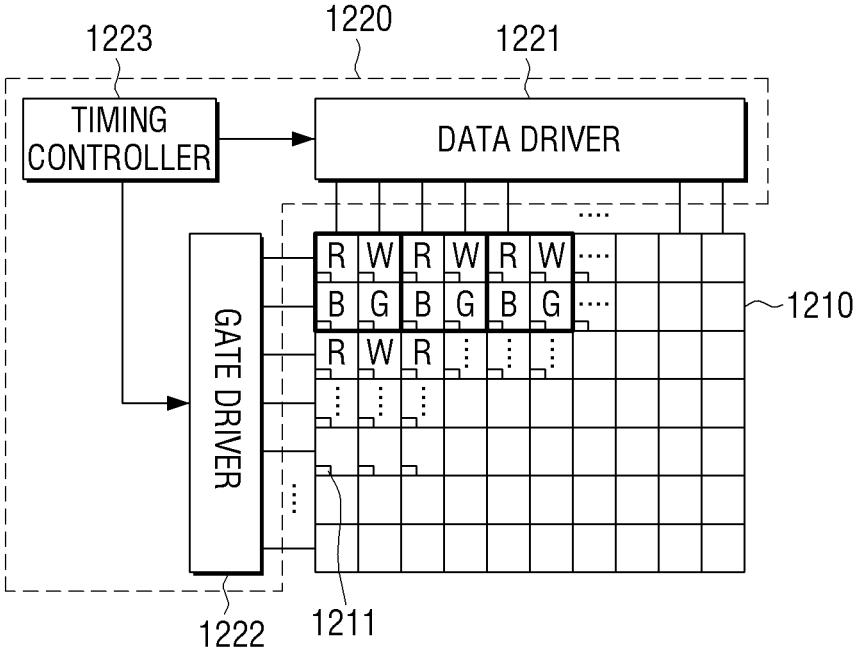
FIG. 12B is a detailed block diagram of a panel driver of the display apparatus of FIG. 12A, according to an exemplary embodiment.

FIG. 12B is a detailed block diagram of the panel driver according to an exemplary embodiment.

Referring to FIG. 12B, the panel driver 1220 may include a data driver 1221, a gate driver 1222, and a timing controller 1223.

The data driver 1221 may be connected to each liquid crystal cell within the display panel 1210 through a plurality of data lines.

The gate driver 1222 may be connected to each liquid crystal cell within the display panel 1210 through a plurality of gate lines.

Each of the data lines may be connected to source electrodes regarding thin film transistors 1211 within the transistor layer included in the display panel 1210, and each of the gate lines may be connected to gate electrodes of the thin film transistors 1211. FIG. 12B illustrates each liquid crystal cell composed of a R subpixel, a G subpixel, a B subpixel and a W subpixel.

The gate driver 1222 may apply the scan pulse through the gate line and perform scanning of turning on the pixels corresponding to each color frame. The data driver 1221 may apply the data signal corresponding to each pixel value within the image data on the scanned pixels and perform displaying.

The timing controller 1223 may apply the controlling signals respectively to the data driver 1221 and the gate driver 1222 according to the image data included in an inputted video signal, and control the scanning and the displaying to be performed respectively.

Although FIG. 12B explains use of the timing controller 1223, a central processing unit (CPU) may substitute for the timing controller 1223 for a display apparatus including a small panel.

Returning to FIG. 12A, the processor 1230 may determine a W subpixel value by signal-processing R, G, B data included in the inputted video signal, determine R, G, B subpixel values based on the determined W subpixel value, and control the panel driver 1220 so that R, G, B, and W subpixels are turned on based on the determined R, G, B, and W subpixel values.

Herein, a plurality of pixels may each include the first package, and the second package disposed adjacent to the first package, in which the first package may include a B subpixel and a G subpixel, and the second package may include a R subpixel and a W subpixel, as described above with respect to FIGS. 3-11.

Further, as illustrated in FIG. 3, the partition which prevents the transmission of the light emitted from the B subpixel and/or the G subpixel to the second package, and prevents the transmission of the light emitted from the R subpixel and the W subpixel to the first package, may be arranged between the first package and the second package.

Further, R, G, B, and W subpixels may be implemented as LEDs.

Specifically, the processor 1230 may determine a W subpixel value by signal-processing R, G, B data included in an inputted video signal. The inputted video signals may include the data regarding R, G, B only, and may omit any data regarding the W subpixel value. Thus, the processor 1230 receiving the video signals determines a W subpixel value from R, G, B data included in an inputted video signal.

Specifically, the processor 1230 may perform gamma conversion regarding R, G, B data, and determine the W subpixel value based on gamma-converted R, G, B data.

Further, the processor 1230 may determine R, G, B subpixel values based on the determined W subpixel value.

Specifically, the processor 1230 may perform gamma conversion regarding R, G, B data, determine a W subpixel value based on gamma-converted R, G, B data, and determine R, G, B subpixel values by performing the inverse gamma conversion regarding a rest of the gamma-converted R, G, B data excluding the determined W subpixel value.

For example, when R, G, B data are gamma-converted respectively to be 80, 60, 70 and when the W subpixel value determined based on gamma-converted R, G, B data values is 50, the processor 1230 may exclude the determined W subpixel value, 50, from gamma-converted R, G, B data values. In other words, when excluding W subpixel value (50) from gamma-converted R data value (80), a rest of the gamma-converted R data value may be 30. When excluding W subpixel value (50) from gamma-converted G data value (60), a rest of the gamma-converted G data value may be 10. Further, when excluding W subpixel value (50) from gamma-converted B data value (70), a rest of the gamma-converted B data value may be 20.

Further, the processor 1230 may perform the inverse gamma conversion regarding the rest of the gamma-converted R, G, B data values, 30, 10, 20, and determine R, G, B subpixel values.

Further, the processor 1230 may control the panel driver 1220 so that R, G, B, and W subpixels are turned on based on the determined R, G, B, and W subpixel values as described above.

The process for obtaining R, G, B, and W subpixel values will be specifically explained below by referring to FIG. 13.

Figure 13:
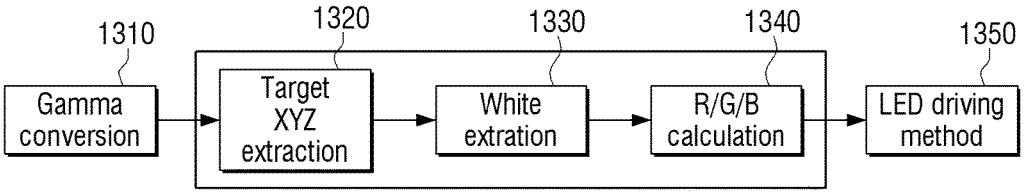
FIG. 13 is a diagram provided to explain a process of determining R, G, B, and W subpixel values according to an exemplary embodiment.

FIG. 13 is a diagram provided to explain the process for determining R, G, B, and W subpixel values according to an exemplary embodiment.

Referring to FIG. 12A and FIG. 13, the processor 1230 may perform gamma conversion regarding R, G, B data included in an inputted video signal, at block 1310, and calculate the target X, Y, Z values based on gamma-converted R, G, B data, at block 1320. Herein, the target X, Y, Z values indicate values measured actually on the display panel 1210 when R, G, B data included in an inputted video signal are implemented to be R, G, B subpixel values on the display panel 1210 and the video is displayed.

Specifically, the processor 1230 may calculate the target X, Y, Z values based on gamma-converted R, G, B data using the following mathematical formula 1.

$$\begin{bmatrix} X_T \\ Y_T \\ Z_T \end{bmatrix} = \begin{bmatrix} X_r & X_g & X_b \\ Y_r & Y_g & Y_b \\ Z_r & Z_g & Z_b \end{bmatrix} \begin{bmatrix} R \\ G \\ B \end{bmatrix} \quad \text{[Mathematical Formula 1]}$$

Thus, [R; G; B] on the right side indicates gamma-converted R, G, B data, [XT; YT; ZT] indicates the target X, Y, Z values, and the 3×3 matrix indicates conversion matrix to convert gamma-converted R, G, B data into the target X, Y, Z values.

Further, the processor 1230 may extract a W subpixel value within a range that may not exceed the target X, Y, Z values, at block 1330.

Specifically, the processor 1230 may extract a W subpixel value using the following mathematical formula 2.

$$\begin{bmatrix} X_T \\ Y_T \\ Z_T \end{bmatrix} = \begin{bmatrix} X_r & X_g & X_b \\ Y_r & Y_g & Y_b \\ Z_r & Z_g & Z_b \end{bmatrix} \begin{bmatrix} R' \\ G' \\ B' \end{bmatrix} + W \begin{bmatrix} X_w \\ Y_w \\ Z_w \end{bmatrix} \quad \text{[Mathematical Formula 2]}$$

$$\text{where } \begin{bmatrix} X_T \\ Y_T \\ Z_T \end{bmatrix} > W \begin{bmatrix} X_w \\ Y_w \\ Z_w \end{bmatrix}$$

Specifically, the target X, Y, Z values may be expressed as a sum of W subpixel values and the matrix conversion of the 3×3 matrix to convert gamma-converted R, G, B data into the target X, Y, Z values with calculated values of the variables R', G', B'.

Herein, the values of the variables R', G', B' may respectively correspond to a rest of the gamma-converted R, G, B data excluding the determined W subpixel, and may be the R subpixel value, the G subpixel value, and the B subpixel value.

Further, the processor 1230 may determine R, G, B subpixel values based on the extracted W subpixel value, at block 1340.

Thus, the processor 1230 may exclude the extracted W subpixel value from gamma-converted R, G, B data respectively, perform the inverse gamma conversion regarding the above excluding result, and determine R, G, B subpixel values.

Specifically, the processor 1230 may calculate the rest values (R', G', B') using the following mathematical formula 3.

$$\begin{bmatrix} R' \\ G' \\ B' \end{bmatrix} = \begin{bmatrix} X_r & X_g & X_b \\ Y_r & Y_g & Y_b \\ Z_r & Z_g & Z_b \end{bmatrix}^{-1} \cdot \left( \begin{bmatrix} X_T \\ Y_T \\ Z_T \end{bmatrix} - W \begin{bmatrix} X_w \\ Y_w \\ Z_w \end{bmatrix} \right) \quad \text{[Mathematical Formula 3]}$$

where, [XT; YT; ZT]−W[XW;YW;ZW] indicates remaining values after subtracting the target X, Y, Z values, i.e., gamma-converted R, G, B data, respectively from the W subpixel value. Thus, R, G, B subpixel values (R', G', B') may be determined by performing the inverse gamma conversion regarding such remaining values.

Accordingly, the processor 1230 may extract the R subpixel value, the G subpixel value, the B subpixel value, and the W subpixel value from R, G, B data included in an inputted video signal using the above described processes, and control the panel driver 1220 so that R, G, B, and W subpixels are turned on based on the extracted R, G, B, and W subpixel values.

The processor 1230 may control the panel driver so that a plurality of subpixels are turned on by a preset group unit at one video frame section, and the subpixel groups arranged at a position shifted by a preset subpixel unit are sequentially turned on.

Specifically, the processor 1230 may turn on a plurality of subpixels by a preset group unit within a certain section of one video frame among a plurality of video frames constructing the inputted video signal, and sequentially turn on the subpixel groups arranged at a position shifted by a preset subpixel unit within some another section of one video frame.

Thus, the processor 1230 may time-divide one video frame section and emit the subpixels included in the display panel 1210 at least once or more. Accordingly, the effect of increased resolution can be obtained because the resolution corresponding to one video frame section can be compensated.

Figure 14:
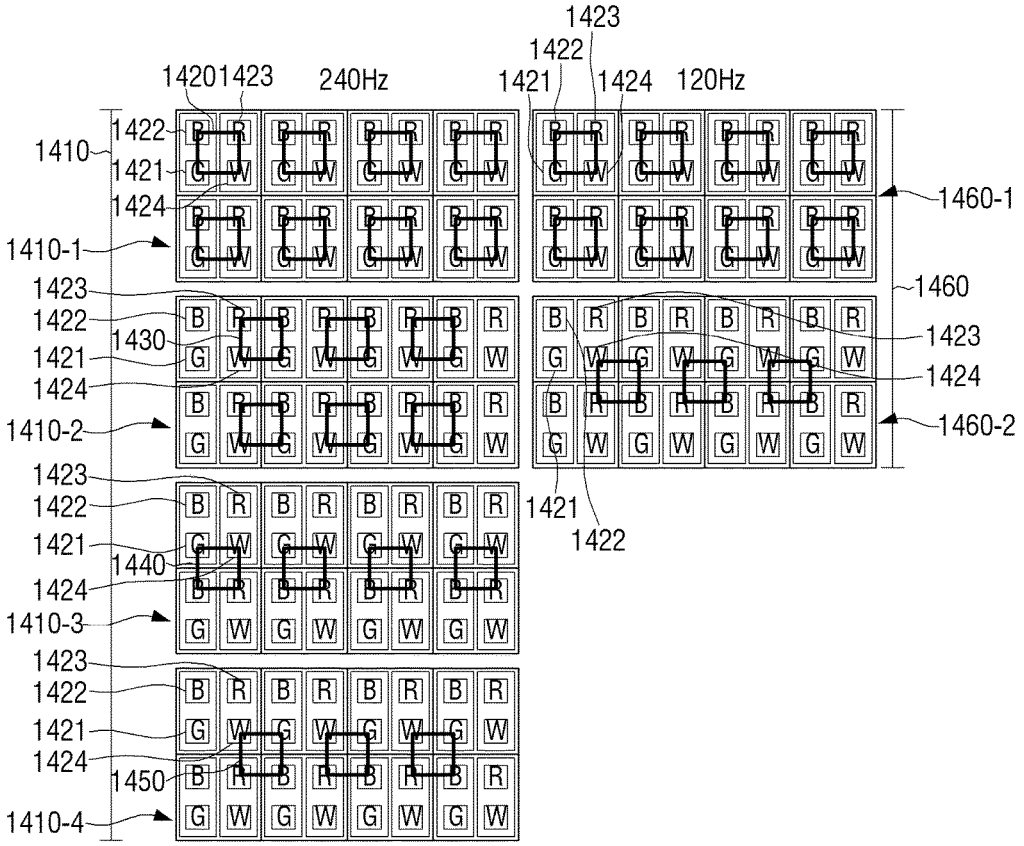
FIG. 14 is a diagram provided to explain a method for turning on a plurality of subpixels according to an exemplary embodiment.

FIG. 14 is a diagram provided to explain a method for turning on a plurality of subpixels according to an exemplary embodiment.

Referring to FIG. 14, the display panel may include a plurality of pixels, each including R, G, B, and W subpixels. Herein, B subpixel 1422 and G subpixel 1421 may be included in one package of a pixel, and R subpixel 1423 and W subpixel 1424 may be included in another one package of the pixel. Herein, W subpixel 1424 may emit the white light, and thus, the brightness may be increased.

The arrangement of R, G, B, and W subpixels illustrated in FIG. 14 may be a PenTile structure in which the subpixels are arranged in the square shape, but the arrangement is not limited herein. As one example, alternatively, the subpixels may be disposed in a diagonal-direction arrangement.

Specifically, a method for controlling a plurality of subpixels by using the driving frequency of 240 Hz in the display panel 1210 will be explained below.

When the driving frequency of 240 Hz is used, the processor 1230 may turn on a plurality of R, G, B, and W subpixels as preset group units, in four subfield sections 1410-1, 1410-2, 1410-3, and 1410-4 of one video frame section 1410.

The processor 1230 may turn on a plurality of R, G, B, and W subpixels 1423, 1421, 1422, 1424 grouped as a preset group unit 1420, in a first subfield section 1410-1 of one video frame section 1410. Further, the preset group units 1420 may be consecutively arranged.

Further, in a second subfield section 1410-2 of one video frame section 1410, the processor 1230 may turn on the subpixel group 1430 arranged at a shifted position where some of the subpixels 1421, 1422, 1423, 1424 turned on in the first subfield section 1410-1 are included.

Thus, R subpixel 1423 and W subpixel 1424 turned on in the first subfield section 1410-1 may also be turned on in the second subfield section 1410-2. Accordingly, the subpixel group 1430 arranged at the shifted position, as well as R subpixel 1423 and W subpixel 1424 turned on in the first subfield section 1410-1, may be turned on. Further, the interval of shifting may be implemented to be the preset subpixel unit so as to include R subpixel 1423 and W subpixel 1424 turned on in the first subfield section 1410-1.

Further, in the second subfield section 1410-2, the processor 1230 may control so as to sequentially turn on the subpixel group 1430 arranged at a position which is shifted to a horizontal direction by a preset subpixel unit from the preset group unit 1420 that are turned on in the first subfield section 1410-1. Then in a third subfield section 1410-3, the processor 1230 may control so as to sequentially turn on the subpixel group 1440 arranged at a position which is shifted in a vertical direction by a preset subpixel unit from the preset group unit 1420 that are turned on in the first subfield section 1410-1.

Further, in a fourth subfield section 1410-4, the processor 1230 may control so as to sequentially turn on the subpixel group 1450 arranged at a position which is shifted in a vertical direction and a horizontal direction by a preset subpixel unit from the preset group unit 1420 that are turned on in the first subfield section 1410-1.

As described above with reference to the second subfield section 1410-2, the preset subpixel units of the third subfield section 1410-3 and the fourth subfield section 1410-4 are the shifting intervals that include some of the subpixels turned on in the first subfield section 1410-1.

Further, the processor 1230 may turn on a plurality of subpixels for four times in total during one video frame section 1410. Thus, the resolution compensation effect may be increased.

As a result, from the second subfield section 1410-2 to the fourth subfield section 1410-4, the processor 1230 may sequentially turn on the subpixel groups 1430, 1440, 1450 including a plurality of subpixels present between the preset group units 1420 that are turned on in the first subfield section 1410-1.

As shown on the right-hand side of FIG. 14, when a plurality of subpixels are controlled by using the driving frequency of 120 Hz, the processor 1230 may sequentially turn on a plurality of R, G, B, and W subpixels as preset group units in two subfield sections 1460-1 and 1460-2 during one video frame section 1460.

Specifically, the processor 1230 may turn on a plurality of R, G, B, and W subpixels as a preset group unit in a first subfield section 1460-1 during one video frame section 1460. Thereafter, in a second subfield section 1460-2, the processor 1230 may turn on the subpixel groups arranged at a shifted position including some of the subpixels turned on in the first subfield section 1460-1.

As shown with respect to the left-hand and right-hand sides of FIG. 14, the processor 1230 may shift the subpixel groups by differently applying the preset subpixel unit based on the driving frequency of the display panel 1210.

Thus, when the processor 1230 turns on a plurality of subpixels by using the driving frequency of 240 Hz, the processor may shift and sequentially turn on the subpixels grouped in preset group units in four subfield sections 1410-1 through 1410-4. When using the driving frequency of 120 Hz, the processor 1230 may shift and sequentially turn on the subpixels grouped in preset group units in two subfield sections 1460-1 and 1460-2. Thus, the preset subpixel units applied as the shifting intervals may be different from each other.

For example, when using the driving frequency of 120 Hz, the processor 1230 may control so as to turn on the subpixel groups arranged at a position shifted from the position in the first subfield section 1460-1 by a preset subpixel unit in a vertical direction and a horizontal direction in the second subfield section 1460-2. When using the driving frequency of 240 Hz, the processor 1230 may control so as to turn on the subpixel groups arranged at a position shifted from the position in the first subfield section 1410-1 by a preset pixel unit in a horizontal direction in the second subfield section 1410-2. Comparing the above two examples reveals different shifting amounts from each other.

Thus, when using the driving frequency of 120 Hz, the processor 1230 may skip the processes for turning on a plurality of subpixels in the second subfield section 1410-2 and the third subfield section 1410-3 as used in the example of using the driving frequency of 240 Hz, and only perform the processes for turning on a plurality of subpixels in the first subfield section 1410-1 and the fourth subfield section 1410-4, thus providing an effect of compensated resolution.

As described above, when using a W subpixel, the brightness of the white light emitted through W subpixel may be relatively higher than the red color light, the green color light, and the blue color light emitted through a R subpixel, a G subpixel and a B subpixel, respectively. Thus, when comparing with a display panel using R, G, B subpixels only, consumption of electrical power may be reduced by half.

Figure 15:
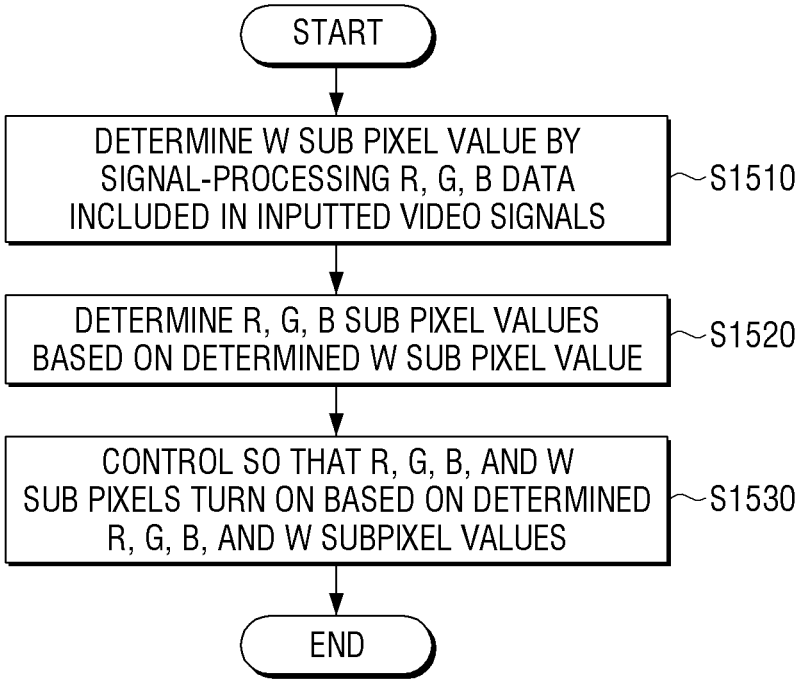
FIG. 15 is a flowchart provided to explain a controlling method of a display apparatus including a display panel according to an exemplary embodiment.

FIG. 15 is a flowchart provided to explain a controlling method of a display apparatus including the display panel having a plurality of pixels including R, G, B, and W subpixels, according to an exemplary embodiment.

The controlling method of the display apparatus including the display panel having a plurality of pixels including R, G, B, and W subpixels illustrated in FIG. 15 may determine a W subpixel value by signal-processing R, G, B data included in an inputted video signal at S1510.

At S1520, R, G, B subpixel values may be determined based on the determined W subpixel value.

At S1530, controlling is performed so that R, G, B, and W subpixels are turned on based on the determined R, G, B, and W pixel values.

Herein, a plurality of pixels may each include the first package and the second package disposed adjacent to the first package. The first package may include a B subpixel and a G subpixel while the second package may include a R subpixel and a W subpixel.

Further, a partition may be provided between the first package and the second package. The partition prevents the transmission of the light emitted from the B subpixel and the G subpixel of the first package to the second package, and prevents the transmission of the light emitted from the R subpixel and the W subpixel of the second package to the first package.

Herein, the W subpixel may include a B subpixel and a yellow phosphor.

Further, R, G, B, and W subpixels each may be implemented as a light emitting diode (LED).

Further, the process for determining the W subpixel value may include performing gamma conversion regarding R, G, B data, and determining the W subpixel value based on gamma-converted R, G, B data.

Further, the process for determining R, G, B subpixel values may include determining R, G, B subpixel values by performing the inverse gamma conversion regarding a remainder of the gamma-converted R, G, B data excluding the determined W subpixel.

Further, the controlling method of the display apparatus according to an exemplary embodiment may further include controlling so as to turn on a plurality of pixels as a preset group unit in one video frame section and sequentially turning on the subpixels arranged at a position shifted by a preset subpixel unit.

A non-transitory computer readable recording medium storing a program sequentially performing the controlling method described above according to an exemplary embodiment may be provided.

For example, a non-transitory computer readable recording medium may be provided, storing a program with instructions for determining a W subpixel value by signal-processing R, G, B data included in an inputted video signal, determining R, G, B subpixel values based on the determined W subpixel value, and controlling so as to turn on R, G, B, and W subpixels based on the determined R, G, B, and W subpixel values.

The 'non-transitory computer readable recording medium' as used herein refers to a medium which stores data semi-permanently and can be read by devices, rather than a medium storing data temporarily, such as register, cache, or memory. Specifically, the above various applications or programs may be stored and provided in non-transitory computer readable recording medium such as CD, DVD, hard disk, Blu-ray disk, USB, memory card, ROM, and so on.

Further, although the above block diagrams illustrating the display apparatus omit illustration of a bus, the communication between the components of the display apparatus may be performed through a bus. Further, each device may additionally include a processor for performing the above-described various processes such as one or more central processing units (CPUs), one or more microprocessors, and so on.

Further, the foregoing exemplary embodiments and advantages are merely exemplary and are not to be construed as limiting the exemplary embodiments. The present teaching can be readily applied to other types of apparatuses.

Also, the description of the exemplary embodiments of the present inventive concept is intended to be illustrative, and not to limit the scope of the claims.

What is claimed is:

1. A display panel comprising:

a plurality of pixels, each pixel comprising a first package and a second package disposed adjacent to the first package, wherein the first package comprises a first plate on which a blue (B) subpixel and a green (G) subpixel are disposed, and the second package comprises second plate, different from the first plate, on which a red (R) subpixel and a white (W) subpixel are disposed.

2. The display panel of claim 1, wherein a partition is disposed between the first package and the second package to prevent transmission of light emitted from the B subpixel and the G subpixel to the second package, and to prevent transmission of light emitted from the R subpixel and the W subpixel to the first package.

3. The display panel of claim 1, wherein the W subpixel comprises a blue (B) subpixel covered by a yellow phosphor.

4. The display panel of claim 1, wherein the R, G, B, and W subpixels are each implemented as a light emitting diode (LED).

5. A display apparatus comprising:

a display panel comprising a plurality of pixels, each pixel comprising a first package and a second package disposed adjacent to the first package, the first package comprising a first plate on which a blue(B) subpixel and a green(G) subpixel are disposed and the second package comprising second plate, different from the first plate, on which a red(R) subpixel and a white(W) subpixel are disposed;

a panel driver configured to drive the display panel;

a processor configured to, for each pixel, determine a W subpixel value by signal-processing R, G, B data for the pixel included in an inputted video signal, determine R, G, B subpixel values based on the determined W subpixel value, and control the panel driver so that the R, G, B, and W subpixels are turned on based on the determined R, G, B, and W subpixel values.

6. The display apparatus of claim 5, wherein a partition is disposed between the first package and the second package to prevent transmission of a light emitted from the B subpixel and the G subpixel to the second package, and to prevent transmission of a light emitted from the R subpixel and the W subpixel to the first package.

7. The display apparatus of claim 5, wherein the W subpixel comprises a blue (B) subpixel covered by a yellow phosphor.

8. The display apparatus of claim 5, wherein the R, G, B, and W subpixels are each implemented as a light emitting diode (LED).

9. The display apparatus of claim 5, wherein the processor performs, for each pixel, gamma conversion regarding R, G, B data, determines a W subpixel value based on the gamma-converted R, G, B data, and determines R, G, B subpixel values by performing inverse gamma conversion regarding a rest of the gamma-converted R, G, B data excluding the determined W subpixel value.

10. The display apparatus of claim 5, wherein the processor controls the panel driver so that, in one video frame section, a plurality of subpixels are turned on as a preset group unit, and the subpixel groups arranged at a position shifted by a preset subpixel unit are sequentially turned on.

11. A controlling method of a display apparatus including a display panel including a plurality of pixels, each pixel comprising a first package and a second package disposed adjacent to the first package, the first package comprising a first plate on which a blue (B) subpixel and a green (G) subpixel are disposed, and the second package comprising a second plate, different from the first plate, on which a red (R) subpixel and a white (W) subpixel are disposed, the controlling method comprising:

determining, for each pixel, a W subpixel value by signal-processing R, G, B data included in an inputted video signal;

determining R, G, B subpixel values based on the determined W subpixel value; and controlling so that R, G, B, and W subpixels are turned on based on the determined R, G, B, and W subpixel values.

12. The controlling method of claim 11, wherein a partition is disposed between the first package and the second package to prevent transmission of a light emitted from the B subpixel and the G subpixel to the second package, and to prevent transmission of a light emitted from the R subpixel and the W subpixel to the first package.

13. The controlling method of claim 11, wherein the W subpixel comprises a blue (B) subpixel covered by a yellow phosphor.

14. The controlling method of claim 11, wherein the R, G, B, and W subpixels are each implemented as a light emitting diode (LED).

15. The controlling method of claim 11, wherein the determining the W subpixel value comprises performing gamma conversion regarding R, G, B data, and determining the W subpixel value based on the gamma-converted R, G, B data.

16. The controlling method of claim 11, wherein the determining the R, G, B subpixel values comprises determining R, G, B subpixel values by performing inverse gamma conversion regarding a rest of the gamma-converted R, G, B data excluding the determined W subpixel value.

17. The controlling method of claim 11, further comprising controlling so that, in one video frame section, a plurality of pixels are turned on by a preset group unit, and the subpixel groups arranged at a position shifted by a preset subpixel unit are sequentially turned on.

* * * * *